United States Patent [19]

Najjar et al.

[11] Patent Number: 4,776,860

[45] Date of Patent: Oct. 11, 1988

[54] HIGH TEMPERATURE DESULFURIZATION OF SYNTHESIS GAS

[75] Inventors: Mitri S. Najjar, Hopewell Junction; Robert M. Suggitt, Wappingers Falls, both of N.Y.

[73] Assignee: Texco Inc., White Plains, N.Y.

[21] Appl. No.: 107,065

[22] Filed: Oct. 13, 1987

Related U.S. Application Data

[63] Continuation-in-part of Ser. No. 101,519, Sep. 28, 1987.

[51] Int. Cl.[4] ..... C10J 3/46

[52] U.S. Cl. ..... 48/197 R; 48/206; 48/215; 48/DIG. 2; 252/373

[58] Field of Search ..... 48/197 R, 203, 206, 48/210, 211, 215, DIG. 2; 252/373; 110/347; 423/230, 231

[56] References Cited

U.S. PATENT DOCUMENTS

| | | | |
|---|---|---|---|
| 3,784,364 | 1/1974 | Slater et al. | 48/215 |
| 4,201,751 | 5/1980 | Holter et al. | 423/230 |
| 4,289,502 | 9/1981 | Muenger et al. | 48/77 |
| 4,547,203 | 10/1985 | Jahake | 48/206 |
| 4,655,792 | 4/1987 | Kessler et al. | 48/215 |
| 4,668,429 | 5/1987 | Najjar | 252/373 |
| 4,705,536 | 11/1987 | Becker et al. | 48/197 R |

*Primary Examiner*—Peter Kratz

*Attorney, Agent, or Firm*—Robert A. Kulason; James J. O'Loughlin; Albert Brent

[57] ABSTRACT

Synthesis gas, fuel gas, or reducing gas is produced by the noncatalytic partial oxidation of a sulfur-containing liquid hydrocarbonaceous fuel or a slurry of sulfur-containing solid carbonaceous fuel with a free-oxygen containing gas in a first free-flow reaction zone $R_1$ located in a refractory lined gas generator at an autogenous temperature in the range of about 190° F. to 2900° F. and above the ash-fusion temperature of the slag formed in the reaction zone. About 85 to 99 weight percent of the carbon in the fuel feed to the reaction zone is converted into carbon oxides. At least a portion of the hot effluent gas stream from the first reaction zone is passed through a free-flow second reaction zone $R_2$ in admixture with a second portion of sulfur-containing fuel and a calcium-containing additive. An equilibrium oxygen concentration with a partial pressure which is less than about $10^{-12}$ atmosphere is provided in the gas phase in the first and second reaction zones. In the second reaction zone the carbon in the second portion of fuel, unconverted fuel and particulate matter from $R_1$ react with $H_2O$ and/or $CO_2$ to produce supplemental $H_2$ and/or carbon oxides. Further, at least a portion of the sulfur-containing gases produced in $R_1$ and $R_2$ e.g. $H_2S$ and COS react at high temperature with the calcium-containing additive to produce particulate matter comprising calcium sulfide. Further, a portion of this newly formed particulate matter and/or the calcium-containing additive combine with slag and/or ash in the hot raw gas stream passing through the second gas cooler. Fly-ash is produced thereby having an increased ash softening temperature. The gas stream discharged from the second reaction zone contains a reduced amount of sulfur-containing gases, and increased amounts of $H_2$+ carbon oxides and calcium sulfide-containing particulate matter.

39 Claims, No Drawings

HIGH TEMPERATURE DESULFURIZATION OF SYNTHESIS GAS

This application is a continuation-in-part of application Ser. No. 07/101,519 filed Sept. 28, 1987.

BACKGROUND OF THE INVENTION

This invention relates to the partial oxidation of sulfur-containing liquid hydrocarbonaceous fuel or a slurry of sulfur-containing solid carbonaceous fuel. More specifically it relates to the in-situ removal of sulfur-containing gases and slag from the raw effluent synthesis gas stream produced in a refractory lined free-flow gas generator.

As supplies of petroleum gradually diminish sulfur-containing heavy liquid hydrocarbonaceous fuel and/or sulfur-containing coal which is America's most abundant form of fossil fuel will play an increasingly major role in providing for the nation's energy requirements. One ton of coal contains the same amount of energy as three to four barrels of crude oil. Accordingly, in the future it will become necessary to produce an increasing fraction of liquid and gaseous fuels from these sulfur-containing comparatively low cost fuels. The synthesis, reducing, and fuel gases produced from these sulfur-containing materials contain a comparatively high e.g. from about 0.1 to 2.0 mole % of $H_2S$ and COS. The desirability for removing, at high temperatures, a major share of the sulfur present in synthesis gas, as generated in a Partial Oxidation Gasification Process, is widely recognized. In particular, removal of sulfur from syngas at high temperatures would improve combined cycle thermal efficiency by eliminating the need for costly cooling of product gases for low temperature acid gas wet scrubbing such as with Selexol or Rectisol. When the synthesis gas is burned as fuel in a gas turbine, it may be unneccesary to remove the last trace of sulfur. Energy savings such as possible through a high temperature desulfurization process can outweigh the need to get an extremely low sulfur content fuel gas. The gas produced by this invention may be used with or without further processing and/or purification as a gaseous fuel or as feedstock for the catalytic synthesis of liquid fuels.

Synthesis gas, fuel gas, and reducing gas may be produced from coal by well known gasification processes. For example, coassigned U.S. Pat. Nos. 3,544,291 and 4,289,502 respectively relate to a process for the partial oxidation of slurries of coal, and to an apparatus for producing cleaned and cooled synthesis gas by the partial oxidation of solid carbonaceous fuel.

The subject invention is an improvement in the art since it permits long time operation of the partial oxidation gas generator without shut-down due to accumulation of slag on metal surfaces in the cooling zone. Further, it is superior to the single-stage mode wherein an iron and calcium containing additive is mixed with the fuel feedstock to the gasifier, such as described in coassigned U.S. Pat. No. 4,668,429, and in U.S. Pat. No. 4,599,955 since lower dosages of calcium can accept more sulfur at the lower temperature in the second reaction zone of the subject invention. Two-stage down-flowing and up-flowing gasification processes are known in the art, including for example U.S. Pat. Nos. 2,801,158; 2,961,310; 3,988,123; 4,436,531; and 4,647,294. However, these processes do not provide for in-situ desulfurization of the product gas. Nor do they provide for the production of supplemental $H_2$ and carbon oxides in the second reaction zone at an increased rate.

SUMMARY OF THE INVENTION

This is an improved two-stage continuous process for the in-situ desulfurization of a stream of synthesis gas, fuel gas or reducing gas. In the first stage, non-catalytic partial oxidation of a first portion of sulfur-containing heavy liquid hydrocarbonaceous fuel and/or sulfur-containing solid carbonaceous fuel with a free-oxygen containing gas takes place in a first reaction zone $R_1$. In the second stage, the following take place in a second reaction zone $R_2$: (i) devolatilizing a second portion of said sulfur-containing fuel; (ii) reaction of carbon from said second portion of sulfur-containing fuel and carbon from the unreacted portion of said first portion of sulfur-containing fuel with $H_2O$ and/or $CO_2$ in the presence of a calcium-containing additive to produce with an increased reaction rate additional $H_2$ and carbon oxides, (iii) conversion of sulfur in said second portion of sulfur-containing fuel into sulfur-containing gases e.g. $H_2S$ and COS; and (iv) in-situ conversion of said sulfur-containing gases into calcium sulfide. The temperature in $R_2$ is lower than that in $R_1$. While the temperature in $R_1$ is above the softening temperature of the ash in $R_1$ thereby producing molten slag, the temperture in $R_2$ is below the softening temperature of the ash and slag in $R_2$ thereby producing fly-ash. The fly-ash may be separated from the product gas by scrubbing with a liquid hydrocarbonaceous material. Further, carbon conversion is increased by the catalytic reactions between carbon and $H_2O$ and/or $CO_2$ in the presence of the calcium-containing additive that take place in the second reaction zone.

The sulfur-containing fuel feedstock is divided into two portions. About 50 to 100 wt. %, such as about 70 to 95 wt. % of the total amount of fuel feedstock is gasified in the first reaction zone; and, the remainder of the fuel feed is gasified in the second reaction zone along with the unreacted portion of the fuel feedstock from the first reaction zone.

A liquid or gaseous carrier is used to introduce the fuel into the first down-flowing or upflowing unobstructed refractory lined vertical cylindrical shaped reaction zone gas generator. An effluent gas stream is produced by the partial oxidation of the sulfur-containing heavy liquid hydrocarbonaceous fuel and/or sulfur-containing solid carbonaceous fuel in the first reaction zone located in a free-flow gas generator at a temperature in the range of about 1900° F. to 2900° F. and above the ash-fusion temperature of the slag formed in the first reaction zone, and a pressure in the range of about 2 to 250 atmospheres. A temperature moderator such as $H_2O$ may be employed when the carrier for the fuel is a liquid hydrocarbon fuel.

The partial oxidation gas generator is operated so as to convert into carbon oxides from about 85 to 99 wt. % of the carbon in the fuel feed entering the first reaction zone. The hot effluent gas stream leaving the gas generator comprises $H_2$, CO, $CO_2$, $H_2S$, COS and at least one gaseous material from the group consisting of $H_2O$, $N_2$, $CH_4$, $NH_3$, and A. Further, entrained in the hot effluent gas stream leaving the first reaction zone is particulate carbon e.g. any remaining unconverted fuel and/or soot and the non-combustible inorganic ash portion of the fuel e.g. slag from the reacted portion of the liquid hydrocarbonaceous or solid carbonaceous fuel.

At least a portion e.g. about 20 to 100 volume % of the hot effluent gas stream leaving the first reaction zone of the gas generator, with or without removal of a portion of the entrained particulate matter and/or slag, is passed through an unobstructed vertical central passage of a second reaction zone comprising a down-flowing, or up-flowing unobstructed refractory lined vertical cylindrical shaped chamber in admixture with a second portion of fuel comprising sulfur-containing heavy liquid hydrocarbonaceous fuel and/or sulfur-containing solid carbonaceous fuel, and a calcium-containing additive. No supplemental free-oxygen containing gas from an external source is introduced into the second reaction zone. The remainder of the hot effluent gas stream, if any, from the first reaction zone may be cooled in a quench tank. Suitable gasification equipment which provide the first and second reaction zones $R_1$ and $R_2$ that are suitable for use in the subject process are shown and described in coassigned U.S. Pat. Nos. 4,248,604; 4,328,006; 4,647,294; and also in U.S. Pat. No. 2,961,310. These patents are incorporated herein by reference. The calcium-containing additive may be introduced into the hot effluent gas stream at the entrance to and/or at one or more locations within the second reaction zone $R_2$. Sufficient calcium-containing additive is introduced into the hot effluent gas stream so as to provide in the second reaction zone $R_2$ calcium atoms in the amount of about 0.95 to 1.8 times the atoms of sulfur in the second reaction zone $R_2$ plus about 0.1 to 0.2 times the atoms of silicon in the ash in the second reaction zone $R_2$. Further, the mole ratio of $H_2O$ and/or $CO_2$ in the second reaction zone to the total amount of carbon in the second portion of fuel that is introduced into the second reaction zone plus the carbon in the unreacted fuel and particulate matter entrained in the hot raw effluent gas stream entering the second reaction zone $R_2$ is in the range of about 0.7 to 25.0, such as about 1.0 to 20.

The hot effluent gas stream enters the second reaction zone $R_2$ at a temperature in the range of about 1900° F. to 2850° F. and leaves at a temperature in the range of about 1000° F. to 2200° F., such as 1500° F. Cooling is effected by devolatilizing the fuel, evaporating any liquid carrier, and by the endothermic reaction of carbon with $H_2O$ and/or $CO_2$. The average temperature in $R_2$ is less than that in $R_1$.

As the effluent gas stream passes through the unobstructed central passage of the second reaction zone, at least a portion i.e. about 50–100 weight percent and preferably all of the sulfur-containing gases in the effluent gas stream e.g. $H_2S$ and COS react with the calcium-containing additive to produce particulate matter comprising calcium sulfide. Further, a portion e.g. about 5 to 20 wt. % of this newly formed particulate matter and calcium-containing additive combine with slag and/or ash in the hot raw gas stream passing through the second reaction zone $R_2$ to produce fly-ash with an increased ash softening temperature in comparison with the ash softening temperature of the ash produced without the addition of the calcium-containing additive. The calcium sulfide leaves the second reaction zone along with the fly-ash portion of the particulate matter entrained in the effluent gas stream. The particulate matter is separated from the effluent gas stream by scrubbing with a liquid hydrocarbonaceous material or by conventional gas-solids separation means. This newly formed particulate matter may be roasted to produce calcium oxide and sulfur-containing gas e.g. $SO_2$. The calcium oxide may be recycled to the second reaction zone as a portion of the calcium-containing additive, and/or introduced into the partial oxidation first reaction zone in admixture with the fuel feed to facilitate removal of the ash. The $SO_2$ may be recovered as a useful by-product. Advantageously, portions of the sensible heat in the stream of hot effluent gas from the partial oxidation reaction zone are recovered by direct heat exchange with the fuel materials, free-oxygen containing gas and carriers flowing through the second reaction zone. Further, the desulfurized product gas is available for use at a higher temperature. Costly reheating is thereby avoided.

DESCRIPTION OF THE INVENTION

The present invention pertains to a continuous two-stage process for the production of a desulfurized stream of synthesis gas, fuel gas, or reducing gas from sulfur-containing heavy liquid hydrocarbonaceous fuel and/or sulfur-containing solid carbonaceous fuel in a liquid or gaseous carrier. The hot effluent gas stream is produced in a first partial oxidation reaction zone. Sulfur-containing gases are then removed from the effluent gas stream in-situ in a second reaction zone at a temperature which is lower than that in the first reaction zone.

A typical down-flowing partial oxidation synthesis gas generator for use in the first stage is shown in coassigned U.S. Pat. No. 2,818,326, which is incorporated herein by reference. The gas generator is a vertical cylindrical steel pressure vessel lined on the inside with a thermal refractory material to provide the first reaction zone $R_1$. The second reaction zone $R_2$ is located downstream from the first reaction zone $R_1$. $R_1$ and $R_2$ may be two down-flowing, two up-flowing, or one down-flowing and one up-flowing vertical cylindrical shaped coaxial chambers. In one embodiment, $R_1$ and $R_2$ are two chambers connected in series by means of a coaxial passage having a diameter which is smaller than one or both chambers. For example, down-flowing vertical serially connected chambers are illustrated in FIG. 1 of coassigned U.S. Pat. No. 4,547,203, which is incorporated herein by reference. For purposes of the subject invention chamber 4 of FIG. 1 may serve as $R_1$; and, chamber 50 may serve as $R_2$. Intervening chamber 23 and side transfer line 27 may or may not be used.

The apparatus shown and described in coassigned U.S. Pat. No. 4,328,006, which is incorporated herein by reference may be also used for carrying out the subject invention. As shown in FIG. 1 of said embodiment, the hot effluent gas from the first down-flowing reaction zone 2 e.g. $R_1$ passes down through passage 5 into first gas diversion and residue separation chamber 4. Particulate solids and slag in the effluent gas stream drop out of the gas stream by gravity and fall through central outlet 30 into slag chamber 6. Quench water 31 may be contained in the bottom of chamber 6, or it may be dry. About 0 to 20 vol. % of the hot effluent gas may be diverted through chamber 6 as bleed gas. The remainder of the hot effluent gas is passed through outlet 43 and refractory 45 lined transfer line into second gas diversion and residue separation chamber 46. Solid material and slag drop through outlet 49 into second slag chamber 53. The hot gas stream passes upwardly through chamber 46 into the bottom of cooling section 65 where noncontact indirect heat exchange takes place with water. The second reaction zone e.g. $R_2$ may be chamber 4 or 46. A gas-solids separation device, such as cyclones 100 and 100a, may be used to separate solid particulate matter from the gas stream.

In another embodiment suitable, up-flowing serially connected chambers 24 and 25 are shown and described in U.S. Pat. No. 2,961,310, which is incorporated herein by reference. Another up-flowing gasifier is shown in U.S. Pat. No. 3,963,457. In carrying out the subject invention, chamber 24 of U.S. Pat. No. 2,961,310 may be used as $R_1$, and chamber 25 may be used as $R_2$. In the down-flowing mode, a burner is located in the top of the gas generator along the central vertical axis for introducing the feed streams into the first reaction zone. A suitable annulus-type burner is shown in coassigned U.S. Pat. No. 2,928,460 which is incorporated herein by reference. A suitable annulus type burner may be used to introduce feedstreams of fuel, $H_2O$ and/or $CO_2$, and calcium-containing additive into the second reaction zone by way of a passage in the side wall of the vessel. For side wall burner installations, see FIGS. 1 and 2 of coassigned U.S. Pat. No. 4,647,294, which is incorporated herein by reference.

In still another embodiment of the subject process reaction zones $R_1$ and $R_2$ are coaxial and horizontally oriented. This embodiment may be carried out by the apparatus shown in coassigned U.S. Pat. No. 3,784,364, which is incorporated herein by reference. In accordance with this embodiment, a liquid hydrocarbonaceous material, steam and/or $CO_2$, calciumcontaining additive, and the effluent gas stream from the first partial oxidation gas generator $R_1$ are passed through the second generator $R_2$ where desulfurization and reactions between carbon and steam and/or $CO_2$ take place in the manner previously described. The temperature in the first reaction zone, e.g., generator 11 is preferably above the softening temperature of the ash, e.g., at least about 10° F.—200° above. Molten slag is thereby produced. The temperature in the second reaction zone e.g. generator 23 is below the softening temperature of the ash, e.g. at least about 10° F.—200° F. below. Fly-ash is thereby produced. Advantageously, by operating at a lower temperature and in the fly-ash mode, more sulfur may be retained in the fly-ash than that which can be retained in molten slag. Further, the amount of calcium-containing additive is reduced since substantially no calcium silicates are formed. However, in comparison with operating both $R_1$ and $R_2$ in the slagging mode, carbon conversion is reduced and gas cleaning is made more difficult by operating $R_2$ in the fly-ash mode.

The term sulfur-containing solid carbonaceous fuel includes coal, such as anthracite, bituminous, subbituminous; coke from coal; lignite; residue derived from coal liquefaction; oil shale; tar sands; petroleum coke; asphalt; pitch; particulate carbon (soot); concentrated sewer sludge; and mixtures thereof. The sulfur content of the solid carbonaceous fuel is in the range of about 0.2 to 8.0 wt. %. The ash or inorganic portion of the solid carbonaceous fuel is in the range of about 0.1 to 30 wt. %. Ash from solid carbonaceous fuel substantially comprises the oxides of Si, Fe, V, Ni and Al. The solid cabonaceous fuel may be ground to a particle size so that 100% passes through an ASTM E11-70 Sieve Designation Standard (SDS) 1.40 mm Alternative No. 14. Pumpable slurries of solid carbonaceous fuels may have a solids content in the range of about 25–70 wt. % such as 45–68 wt. %, depending on the characteristics of the fuel and the slurrying medium. The slurrying medium may be a liquid hydrocarbonaceous material.

The term liquid hydrocarbonaceous material as used herein to describe suitable liquid carriers is intended to include various materials, such a liquified petroleum gas, petroleum distillates and residues, gasoline, naphtha, kerosene, crude petroleum, asphalt, gas oil, residual oil, tar sand oil, shale oil, coal derived oil, aromatic hydrocarbon (such as benzene, toluene, xylene fractions), coal tar, cycle gas oil from fluid-catalytic-cracking operation, furfural extract of coker gas oil, methanol, ethanol and other alcohols, by-product oxygen containing liquid hydrocarbonas from oxo or oxyl synthesis, and mixtures thereof. The term sulfur-containing heavy liquid hydrocarbonaceous fuel, as used herein, is intended to include various materials, such as virgin crude, residue from petroleum distillation and cracking, petroleum distillates, reduced crude, whole crude, asphalt, coal tar, coal derived oil, shale oil, tar sand oil and mixtures thereof. The sulfur and ash contents of the heavy liquid hydrocarbonaceous fuel are respectively in the ranges of about 0.5 to 5.0 weight %; and 100 to 10,000 parts per million. Ash from heavy liquid hydrocarbonaceous fuel substantially comprises the oxides and some sulfides of Fe, Ni, V, and Si.

In the subject invention, it was unexpectedly found that a sufficiently low equilibrium oxygen concentration in the gas phase which is less than about $10^{-12}$ atmospheres is required in reaction zones $R_1$ and $R_2$ for the calcium atoms to capture substantially all of the sulfur atoms in the second reaction zone $R_2$. While the required low equilibrium oxygen concentrations may be achieved with various combinations including minimum amounts of pure oxygen, $H_2O$, and $CO_2$ in reaction zones $R_1$ and $R_2$, air gasification of the sulfur-containing fuel feed in $R_1$ in the presence of a temperature moderator comprising nitrogen or recycle product gas is a preferred mode of operation. The use of a temperature moderator to moderate the temperature in the first reaction zone of the gas generator and optionally in the second reaction zone depends in general on the carbon to hydrogen atomic ratio of the feedstock, the oxygen content of the oxidant stream, and the desired low oxygen potential. Suitable temperature moderators include nitrogen, recycle synthesis gas, steam, water, $CO_2$-rich gas, liquid $CO_2$, a portion of the cooled clean exhaust gas from a gas turbine employed downstream in the process with or without admixture with air and mixtures of the aforesaid temperature moderators. Water may serve as the carrier and the temperature moderator with slurries of water and solid carbonaceous fuel. However, steam may be the temperature moderator with slurries of liquid hydrocarbonaceous fuel and solid carbonaceous fuel. Generally, a temperature moderator is used with liquid hydrocarbon fuels and with substantially pure oxygen. The temperature moderator may be introduced into the gas generator in admixture with either the solid carbonaceous fuel feed, the free-oxygen containing gas stream, or both. Alternatively, the temperature moderator may be introduced into the first and/or second reaction zones by way of a separate conduit in the fuel burner. When $H_2O$ or $CO_2$ is introduced into the first and/or second reaction zones either as a temperature moderator, a slurrying medium, or both, the weight ratio of $H_2O$ or $CO_2$ to solid carbonaceous fuel plus liquid hydrocarbonaceous material if any, is in the range of about 0.03 to 0.7 and preferably in the range of about 0.1 to 0.5.

The term free-oxygen containing gas, as used herein in the first reaction zone is intended to include air, oxygenenriched air, i.e. greater than 21 mole % oxygen, and substantially pure oxygen, i.e., greater than 95 mole % oxygen, (the remainder comprising $N_2$ and rare gases). Free-oxygen containing gas may be introduced into the burner at a temperature in the range of about ambient to 1200° F. In the first reaction zone, the atomic ratio of free-oxygen in the oxidant to carbon in the feed stock (O/C atom/atom) is preferably in the range of about 0.3 to 1.1, such as about 0.7 to 0.9. Substantially no supplementary free-oxygen is introduced into the second reaction zone other than that in the raw effluent gas stream from the first reaction zone.

The relative proportions of solid carbonaceous fuel, liquid hydrocarbon fuel if any, water or other temperature moderator, and oxygen in the feed streams to the first reaction zone in the gas generator, are carefully regulated to convert a substantial portion of the carbon in the fuel feed to the partial oxidation gas generator e.g. 85 to 99 wt. %, such as 80 to 95 wt. % of the carbon to carbon oxides e.g. CO and $CO_2$, to maintain an autogeneous reaction zone temperature in the first reaction zone at a temperature in the range of about 1900° F. to 2900° F. and above the ash softening temperature of the slag formed in the reaction zone, and to maintain the equilibrium oxygen concentration in the gas phase with a partial pressure which is less than about $10^{-12}$ atmospheres. The ash in the solid carbonaceous fuel forms, molten slag in the first reaction zone. Molten slag is much easier to separate from the hot effluent gas than fly-ash. The pressure in the first and second reaction zones is in the range of about 2 to 250 atmospheres. The pressure in the second reaction zone is substantially the same as that in the first reaction zone less ordinary pressure drop in the lines. The dwell time in the first reaction zone of the partial oxidation gas generator in seconds is in the range of about 0.5 to 10, such as about 1.0 to 5. The dwell time in the second reaction zone in seconds is in the range of about 5 to 50, such as about 15 to 40 seconds.

The effluent gas stream leaving the first reaction zone in the partial oxidation gas generator has the following composition in mole % depending on the amount and composition of the feedstreams: $H_2$ 8.0 to 60.0, CO 8.0 to 70.0, $CO_2$ 1.0 to 50.0, $H_2O$ 2.0 to 50.0, $CH_4$ 0.0 to 2.0, $H_2S$ plus COS 0.10 to 2.0, $N_2$ 0.0 to 80.0, and A 0.0 to 2.0. Trace amounts of the following gaseous impurities may be also present in the effluent gas stream in parts per million (ppm): HCN 0 to 100; such as about 2 to 20; HCl 0 to about 20,000, such as about 200 to 2,000; and $NH_3$ O to about 10,000, such as about 100 to 1000. Entrained in the effluent gas stream is about 0.5 to 20 Wt. %, such as 1 to 4 wt. % particulate carbon (basis weight of carbon in the feed to the gas generator) comprising the remaining portion of the unconverted ash-containing solid carbonaceous fuel feed and/or soot. Molten slag resulting from the fusion of the ash content in the fuel or fly-ash is also entrained in the gas stream leaving the gas generator $R_1$.

The calcium-containing additive may be introduced into the hot effluent gas stream at the entrance to and/or at one or more locations within the second reaction zone. Sufficient calcium-containing additive is introduced into the hot effluent gas stream so as to provide in the second reaction zone $R_2$, calcium atoms in the amount of about 0.95 to 1.8 times the atoms of sulfur in the second reaction zone $R_2$ plus about 0.1 to 0.2 times the atoms of silicon in the ash in the second reaction zone $R_2$. Further, the mole ratio of $H_2O$ and/or $CO_2$ in the second reaction zone to the total amount of carbon in the second portion of fuel introduced into the second reaction zone plus the carbon in the unreacted fuel and particulate matter entrained in the hot raw effluent gas stream entering the second reaction zone $R_2$ is in the range of about 0.7 to 25, such as about 1.0 to 20. The hot effluent gas stream from the gas generator may be passed in a downward or upward direction through the second reaction zone.

The calcium-containing additive having a particle size (microns) in the range of about 1.0 to 1000, such as about 5.0 to 100, may be sprayed into the effluent gas stream at the entrance to or within the second reaction zone $R_2$ by means of spray nozzles, aspirators or atomizers. Any suitable number and arrangement of spray nozzles, aspirators, atomizers, or other suitable mixing means may be employed which allow the calcium-containing material to intimately contact and mix with the hot effluent gas stream. For example, at least one spray nozzle may be located within the second reaction zone $R_2$ at the entrance so that the entering hot effluent gas stream may be immediately contacted by an atomized spray of calcium-containing additive. At least one spray nozzle for spraying calcium-containing material may be longitudinally spaced at various levels at and/or beyond the entrance of the second reaction zone $R_2$ e.g. along the central axis.

In one embodiment, the fuel feed to the second reaction zone comprises a pumpable slurry of sulfur-containing solid carbonaceous fuel in admixture with calcium-containing additive material having a solids content of about 50-70 wt. % in a liquid carrier selected from the group consisting $H_2O$, $CO_2$ and liquid hydrocarbonaceous fuel. However, when the liquid carrier is $H_2O$ or $CO_2$, prior to introducing said slurry into the second reaction zone, the liquid carrier is skimmed off the slurry to reduce the amount of $H_2O$ to about 5 to 10 wt. % (basis weight of feed), or alternatively to reduce the amount of $CO_2$ to about 10 to 30 wt. % (basis weight of feed).

After the carrier is vaporized, the calciumcontaining additive that becomes intimately associated with the sulfur in the sulfur-containing gases and any molten slag and/or ash particles in the effluent gas passing through the second reaction zone $R_2$ provides calcium atoms in the amount of about 0.95 to 1.8 times the atoms of sulfur in the second reaction zone $R_2$ plus about 0.1 to 0.2 times the atoms of silicon in the ash in the second reaction zone $R_2$. In another embodiment, the calcium-containing additive is entrained in a gaseous medium selected from the group consisting of steam, air, $CO_2$, $N_2$, recycle synthesis gas, and mixtures thereof. A suitable apparatus for carrying out this mode is illustrated in FIG. 1 of coassigned U.S. Pat. No. 4,248,604, which is incorporated herein by reference. In this embodiment, partial oxidation of a first portion of a slurry of sulfur-containing coal or other carbonaceous solid fuel e.g. petroleum coke takes place in the first reaction zone $R_1$-e.g. reference No. 16. A first portion of the hot raw effluent gas stream is mixed in the second reaction zone $R_2$-e.g. refractory lined antichamber 51, with a gas-solid mixture that is introduced into antichamber 51 via line 63 and comprising particles of a second portion of sulfur-containing coal or other sulfur-containing liquid hydrocarbonaceous or solid carbonaceous fuel in admixture with a calcium-containing additive which is entrained in a cooled and cleaned stream of recycle product gas. The following reactions take place in the second reaction zone $R_2$ e.g. antichamber 51: (i) devolatilizing of the second portion of said sulfur-containing fuel; (ii) reaction of carbon from said second portion of sulfur-containing fuel and carbon from any unreacted portion of said first portion of sulfur-containing fuel with $H_2O$ and/or $CO_2$ in the presence of a calcium-containing additive to produce with an increased reaction rate additional $H_2$ and carbon oxides; (iii) conversion of sulfur in said second portion of sulfur-containing fuel into sulfur containing gases e.g. $H_2S$ and COS; and (iv) desulfurization by the reaction between the sulfur containing gases and the calcium-containing additive to produce particles of calcium sulfide. The entrained particulate matter, including calcium sulfide and slag particles, is separated from the hot raw stream of synthesis gas by means of cyclone 56 and is passed out of antichamber 51 via bottom outlet 52. The material in line 59 may be ground and mixed with the sulfur-containing coal slurry fuel to gas generator 11, as an ash temperature modifier. Alternatively, it may be roasted and processed to produce calcium oxide which is recycled to antichamber 51. Further cooling and scrubbing of the raw stream of synthesis gas in line 64 may be accomplished in shell and tube gas coolers 65 and 66, and in gas scrubber 121. The cooled and cleaned synthesis gas leaves via line 159.

By the subject process, in the second reaction zone $R_2$, at least a portion e.g. 50 to 100 wt. %, such as about 70 to 95 wt. % of the sulfur originally present in the fuel feed and now in the form of sulfur-containing gases e.g. $H_2S$, COS react with the calcium-containing additive to produce particulate matter comprising calcium sulfide. Further, the mole % $H_2S$+COS in the effluent gas stream leaving antichamber 51 is reduced from a mole % of about 0.10 to 2.0 to less than about 0.05 mole % by the subject process.

The calcium-containing additive may comprise an inorganic or an organic calcium compound. In one embodiment, the calcium-containing additive is an organic compound selected from the group consisting of formate, oxalate, acetate, stearate, benzoate, tartrate, and mixtures thereof. Preferably, the calcium-containing additive is a calcium compound selected from the group consisting of calcium oxide, calcium hydroxide, calcium carbonate, calcium hydride, calcium nitrate, calcium phosphate, and mixtures thereof.

In the preferred embodiment, the gas stream enters the second reaction zone $R_2$ substantially the same temperature as that which it had when it left the first reaction zone $R_1$ of the partial oxidation gas generator i.e. about 1900° F. to 2900° F., less any ordinary drop in the lines i.e. about 50° F. to 100° F. temperature drop. Preferably, the temperature of the entering gas stream is above the ash-softening temperature of any ash that may be entrained in the gas stream. The gas stream leaves at the opposite end of the second reaction zone $R_2$ after its temperature has been reduced to a temperature in the range of about 1000° F.-2850° F., such as about 1350° F.-1800° F. The pressure of the gas stream in the second reaction zone $R_2$ is substantially the same as that in the gas generator, less ordinary pressure drop in the lines i.e. about 1 atmosphere pressure drop. At these temperatures and pressures, sulfur-containing gases e.g. $H_2S$ and COS that are produced in the partial oxidation reaction zone $R_1$ and $R_2$ react with the calcium-containing additive to produce calcium sulfide. From about 50 to 100 wt. %, such as about 70 to 95 wt. % of the calcium sulfide leaves the second reaction zone $R_2$ in the form of discrete particles entrained in the effluent gas stream. A portion of the newly formed particles of calcium sulfide e.g. about 0 to 10 wt. % and/or calcium-containing additive combines with slag and/or ash in the hot raw gas stream passing through the second reaction zone $R_2$. The fly-ash produced thereby has an increased ash softening temperature in comparison with the molten slag entering the second reaction zone $R_2$. Molten slag in the gas stream passing through the second reaction zone $R_2$ may be converted into solid particles when its temperature falls below the melting point of the slag. At least a portion e.g. about 10 to 100 wt. % of the fly-ash may be separated from the hot raw gas stream by conventional means e.g. cyclone and/or scrubbing with a liquid hydrocarbonaceous material. The remainder of the fly-ash, if any, may leave the second reaction zone $R_2$ entrained in the partially cooled gas stream. In one embodiment, the partially cooled gas stream leaving the second reaction zone $R_2$ is passed through a gas cooler e.g. radiant cooler. By-product steam may be thereby produced by indirect heat exchange. At least a portion of the fly-ash is collected in a catch pot or quench tank located at the lower end or entrance to the vertical radiant cooler. See slag chamber 53 of coassigned U.S. Pat. No. 4,328,006, which is incorporated herein by reference. The remaining particles of calcium-sulfide leave the radiant cooler suspended in the cooled effluent gas stream. In one embodiment, the vertical radiant cooler serves as the second reaction zone $R_2$. The calcium-containing additive is then introduced into the gas stream entering the radiant cooler, or at some other location within the radiant cooler. The particles of calcium sulfide and particulate carbon e.g. uncoverted fuel particles and/or soot may be separated from the effluent gas stream by conventional gas-solids separation means. In one embodiment, the particles of calcium sulfide and carbon-containing material are separated from the cooled and desulfurized stream of synthesis gas leaving the second reaction zone by means of a cyclone separator or impingement separator of the types shown in coassigned U.S. Pat. Nos. 4,328,006 and 4,377,394, which are incorporated herein by reference. The separated calcium-sulfide and particulate carbon may be roasted to produce calcium oxide and sulfur-containing gas. The calcium oxide and a substantially small amount of other particulate solids, if any, e.g. less than about 1.0 wt. % of ash are then separated from the sulfur-containing gases by conventional gas-solids separation means. The calcium oxide may be recycled to the second reaction zone $R_2$ where it is introduced in admixture with make-up calcium-containing additive and a second portion of the sulfur-containing liquid hydrocarbonaceous or solid carbonaceous fuel. In one embodiment, a portion of the calcium oxide may be recycled to the first reaction zone $R_1$ in the partial oxidation gas generator in admixture with said heavy liquid hydrocarbonaceous and/or solid carbonaceous fuel. In one embodiment, prior to roasting, the separated particulate matter is classified e.g. screened to remove material having a particle size greater than about 100 microns. This oversized material is rich in non-calcium sulfide material e.g. silicates. In one embodiment, at least a portion e.g. 10 to 100 wt. % of said oversized material is mixed with the sulfur-containing heavy liquid hydrocarbonaceous fuel feed and/or the sulfur-containing solid carbonaceous fuel feed and introduced into the reaction zone of the partial oxidation gas generator as an ash-fusion temperature modifying agent.

In one embodiment, the hot raw product gas mixture from the second reaction zone is cooled and cleaned by the steps of (1) contacting said hot raw product gas mixture with a liquid hydrocarbonaceous fuel cooling and scrubbing agent thereby producing a slurry comprising fly-ash and calcium sulfide in liquid hydrocarbonaceous fuel; (2) steam stripping said slurry to produce sulfur-containing gases e.g. $H_2S$, and calcium oxide; and recycling the sulfur-depleted calciumcontaining slurry to the second reaction zone. Sulfur may be recovered from the mixture of steam and $H_2S$.

Advantageously, in the subject process the catalytic reaction between carbon monoxide and steam may take place in the second reaction zone $R_2$ to produce additional hydrogen and carbon dioxide. In addition, carbon and steam may react in the second reaction zone $R_2$ to produce additional hydrogen and carbon oxides. These reactions may be catalyzed by the calcium-containing additive materials.

Advantageously, useful thermal energy may be recovered from the hot effluent gas stream leaving the second reaction zone $R_2$ by passing it through a gas cooler. For example, by indirect heat exchange between the gas stream flowing through the central passageway of the radiant cooler and the cooling water flowing through the tube-wall, by-product steam may be produced.

The comparatively clean and partially cooled gas stream may leave the downstream end of the gas solids separation zone at a temperature below the maximum safe operating temperature for downstream devices used to recover energy from the hot gas stream such as a conventional convection type gas cooler, an expansion turbine for the production of mechanical or electrical energy, or both. The gas stream may be then passed through a downstream convection-type gas cooler or some other energy utilizing means where its temperature is reduced to a range of about 150° to 600° F. The gas stream may be then optionally subjected to additional process steps including gas scrubbing, methanation reactions, and purification, depending on its intended use as a synthesis gas, reducing gas, or fuel gas.

The advantages achieved by the subject process in which the calcium-containing additive in admixture with a second portion of sulfur-containing liquid hydrocarbonceous and/or solid carbonaceous fuel is introduced directly into the second reaction zone include the following:

1. A $H_2+CO$ containing product gas is produced containing a reduced amount of sulfur-containing gases.

2. The gas stream passing through the second reaction zone $R_2$ is desulfurized while the temperature is maintained at a high level e.g. greater than 1000° F.

3. Supplemental $H_2$ and carbon oxide gases are produced at an increased reaction rate due to the catalytic reaction of carbon and steam in the presence of the calcium-containing additive.

4. The sensible heat in the effluent gas stream from the partial oxidation gas generator may be efficiently used at high temperatures to provide the necessary energy to initiate and to carry out the desulfurization reaction.

5. The residence time in the partial oxidation gas generator may be reduced. This will result in shorter and less costly gas generators.

6. The thermal refractory lining of the gas generator is not subject to attack by contact with a calcium-containing material.

7. Low grade solid fuels may be used as feed to the partial oxidation gas generator, without costly upgrading.

8. The calcium-containing additive may be intimately mixed with the sulfur-containing gases in the hot gas stream in the second reaction zone $R_2$. When a liquid carrier is used and it vaporizes, nascent uncontaminated calcium-containing material is released at an elevated temperature. In this active form, the calcium-containing material is intimately mixed with and contacts the sulfur-containing gases and the slag. The conversion rate for the desulfurization and other reactions in $R_2$ are thereby increased.

9. Separation of the molten slag entrained in the effluent gas stream passing through the second reaction zone $R_2$ may be facilitated. A small portion of the calcium-containing additive and/or newly formed calcium sulfide will react with clay materials in the molten slag to form, for example, calcium aluminosilicates. The melting point of the slag is thereby lowered and its fluidity is increased. In one embodiment, in the lower portion of an up-flowing vertical second reaction zone $R_2$ any fluxed molten slag easily separates from the gas stream and drops into a slag chamber located at the bottom of the second reaction zone. A pool of water may be contained in the bottom of the slag chamber, or it may be dry. In the second reaction zone, the temperature of the gas stream is reduced below the softening temperature of the ash in the fuel so that fly-ash and particulate calcium sulfide may leave the second reaction zone $R_2$ entrained in the gas stream.

In another embodiment, simultaneously with the introduction of the calcium-containing additive into the second reaction zone $R_2$, an ash softening temperature additive may be introduced into the first partial oxidation reaction zone $R_1$ in admixture with the sulfur-containing liquid hydrocarbonaceous fuel and/or sulfur containing solid carbonaceous fuel. By this means, at least a portion of the molten slag e.g. about 10 to 75 wt. % may be removed from the hot raw effluent gas stream prior to the second reaction zone $R_2$. In such case, the weight ratio of ash softening temperature additive in the feed mixture to the gas generator to ash in the fuel feed is in the range of about 0.5 to 10, such as about 2 to 5. The ash-softening temperature additive may be a portion of the previously described calcium-containing additive e.g. about 1 to 75 wt. %, such as 5 to 25 wt. % (basis total weight of iron-containing additive).

In still another embodiment, an alkali metal and/or alkali earth metal catalyst for the reaction between carbon and $H_2O$ or $CO_2$ is introduced into the second reaction zone $R_2$ in admixture with the sulfur-containing liquid hydrocarbonaceous fuel and/or solid carbonaceous fuel and the calcium-containing additive. The catalyst is present in the amount of about 5–50 wt. %, such as about 10–20 wt. % (basis wt. of entrained carbon). The mole ratio $H_2O$ and/or $CO_2$ to carbon in the hot gas stream passing through the second reaction zone $R_2$ is in the range of about 0.7 to 25.0, or more, such as about 1.0 to 20, say about 1.5 to 6. Advantageously, unwanted HCN and HCl may be hydrolyzed in the presence of alkali metal and/or alkaline earth metal catalysts. The alkali metal and/or alkaline earth metal constituents are selected from the metals in the Periodic Table of Elements in Group IA and or IIA.

In one embodiment the sulfur-containing heavy liquid hydrocarbonaceous fuel and/or sulfur-containing solid carbonaceous fuel have ashes that include a minimum of 5.0 wt. % of vanadium, a minimum of 2.0 wt. % of nickel and silicon. Troublesome vanadium and nickel constituents in the ash of these fuels were removed in the slag by introducing into the first reaction zone $R_1$ in admixture with fresh portions of the sulfur-containing fuel feedstock additive A comprising an iron-containing additive when the silicon content of said fuel feedstock is comparatively low, or additive B comprising an iron and calcium-containing additive when the silicon content of said fuel feedstock is comparatively high. For additional information with respect to additives A and B, reference is made to coassigned U.S. Pat. Nos. 4,668,428 and 4,668,429, which are incorporated herewith by reference. The calcium-containing additive in admixture with a second portion of said sulfur-containing fuel is introduced into the second reaction zone along with $H_2O$ and.or $CO_2$, in the manner described previously. In one embodiment, at least a portion of the molten slag in the effluent gas stream from the first reaction zone is removed prior to the second reaction zone.

Further, this embodiment pertains to a continuous process for the production of desulfurized synthesis gas, fuel gas, or reducing gas comprising:

(1) mixing a first portion of sulfur-containing heavy liquid hydrocarbonaceous fuel and/or sulfur-containing solid carbonaceous fuel whose ashes include a minimum of 5.0 wt. % vanadium, a minimum of 2.0 wt. % of nickel, and silicon with additive A comprising an iron-containing additive when the silicon content of said fuel feedstock is less than about 350 ppm, or additive B comprising an iron and calcium-containing additive when the silicon content of said fuel feedstock is about 400 ppm or more; and reacting said mixture by partial oxidation with a free-oxygen containing gas and in the presence of a temperature moderator in a first free-flow refractory lined reaction zone of a gas generator at an autogeneous temperature in the range of about 1900° F. to 2900° F. and above the softening temperature of the ash in the first reaction zone, and a pressure in the range of about 2 to 250 atmospheres to produce a hot stream of synthesis gas, reducing gas, or fuel gas comprising $H_2$, CO, $CO_2$, $H_2S$, COS and at least one gaseous material selected from the group consisting of $H_2O$, $N_2$, $CH_4$, $NH_3$, A, and containing entrained material comprising particulate carbon, unreacted fuel if any, and slag; wherein sufficient additive A or B is introduced into the first reaction zone so as to provide iron atoms when additive A is used or iron and calcium atoms when additive B is used in the amount of about 1.0 to 1.8 times the atoms of sulfur in the first reaction zone plus about 0.3 to 1.2 times the atoms of silicon in the ash in the second reaction zone; and for each part by weight of vanadium there is at least 10 parts by weight of iron when addition A is used, or at least 10 parts by weight of iron and calcium when additive B is used;

(2) passing at least a portion of the hot gas stream from (1) in admixture with a second portion of said sulfur-containing heavy liquid hydrocarbonaceous fuel and/or sulfur-containing solid carbonaceous fuel and a calcium-containing additive through a second unobstructed free-flow refractory lined reaction zone; wherein sufficient calcium-containing additive is introduced into the second reaction zone so as to provide calcium atoms in the amount of about 1.0 to 1.8 times the atoms of sulfur in the second reaction zone plus about 0.1 to 0.2 times the atoms of silicon in the ash from said second portion of sulfur-containing fuel, and the mole ratio of $H_2O$ and/or $CO_2$ to carbon in the second reaction zone is in the range of about 0.7 to 25.0; and the weight ratio of calcium-containing additive to ash in the second reaction zone is in the range of about 1.0–10.0 to 1.0;

(3) devolatilizing said second portion of sulfur-containing fuel and reacting in said second reaction zone in the absence of additional free-oxygen containing gas and at a temperature below that in said first reaction zone and below the ash softening temperature (i) $H_2O$ and/or $CO_2$ with carbon from said second portion of fuel, to produce supplemental $H_2$ and carbon oxides, and (ii) said calcium-containing additive with the sulfur containing gases in the gas streams produced in steps (1) and (2) to produce particulate matter comprising calcium sulfide and combining in said second reaction zone a portion of said newly formed particulate matter and/or calcium-containing additive with slag and/or ash to produce fly-ash having an increased ash softening temperature; and (4) discharging from said second reaction zone a stream of synthesis gas, reducing gas, or fuel gas with entrained fly-ash; and in comparison with a gas stream produced without the introduction of said calcium-containing additive in (2), the gas stream discharged from the second reaction zone contains a reduced amount of sulfur-containing gases, and increased amounts of $H_2$ + carbon oxides and calcium sulfide-containing particulate matter.

The iron-containing additive A in said previous embodiment contains iron compounds selected from the group consisting of oxides, carbonates, carbonyl, nitrates and mixtures thereof. The iron and calcium-containing additive B contains iron and calcium compounds selected from the group consisting of oxides, carbonates, nitrates, and mixtures thereof.

The iron containing portion of said additive A and B is a ferro or ferri organic compound selected from the group consisting of naphthenates, oxalates, acetates, citrates, benzoates, oleates, tartrates, and mixtures thereof. For example the iron-containing portion of additive A or B is iron oxide; and in additive B said iron oxide is in admixture with calcium oxide. Included in the additive A or B may be an additional material compound selected from the group of elements consisting of magnesium, chromium and mixtures thereof in the total amount of about 1.0 to 10.0 wt. % of said iron-containing additive. Iron-containing additive A comprises about 30.0 to 100.0 wt. % of an iron compound. The iron and calcium-containing additive B comprises about 30.0 to 90.0 wt. % of an iron compound, preferably iron oxide, and the remainder may substantially comprise a calcium compound preferably calcium oxide. The sulfur-containing heavy liquid hydrocarbonaceous fuel having a nickel and vanadium-containing ash feedstock is selected from the group consisting of crude residue from petroleum distillate, reduced crude, whole crude, asphalt, coal tar, coal derived oil, shale oil, tar sand oil, and mixtures thereof. In one embodiment, the sulfur-containing solid carbonaceous fuel having a nickel and vanadium-containing ash is petroleum coke. Substantially all of the sulfur in said feedstock is converted into the sulfides of iron and nickel with additive A and iron, nickel and calcium with additive B and leaves the first reaction zone in the slag. The mixture of additive A or B and feedstock from (1) has a particle size of ASTM E-11 Standard Sieve Designation in the range of about 210 microns to 37 microns, or below. The previously described liquid phase washing agent substantially comprises in wt. %: iron sulfide about 75 to 95 , nickel sulfide about 0.5 to 3.0, and iron oxide about 2 to 9.

The first and second reaction zones may be two free-flow unobstructed vertical cylindrical shaped chambers with the products of reaction passing downwardly or upwardly through the first reaction zone and then downwardly or upwardly through the second reaction zone. For example the first and second reaction zones are two down-flowing coaxial refractory lined free-flow chambers located in the same pressure vessel. Alternatively, the first and second reaction zones are two up-flowing coaxial chambers located in the same pressure vessel. In one embodiment such as accomplished with the apparatus shown in coassigned U.S. Pat. No. 4,328,006 which is incorporated herein by reference, prior to the second reaction zone 4 or 46 at least a portion of the molten slag entrained in the hot effluent gas stream from the first reaction zone is separated from the hot gas stream.

Other modifications and variations of the invention as hereinbefore set forth may be made without departing from the spirit and scope thereof, and therefore only such limitations should be imposed on the invention as are indicated in the appended claims.

We claim:

1. A continuous process for the production of desulfurized synthesis gas, fuel gas, or reducing gas comprising:

(1) reacting a first portion of sulfur-containing heavy liquid hydrocarbonaceous fuel and/or sulfure-containing solid carbonaceous fuel containing about 0.2 to 8.0 wt. % sulfur by partial oxidation with controlled amounts of free-oxygen containing gas and temperature moderator in a first free-flow refractory lined reaction zone of a gas generator at an autogenous temperature in the range of about 1900° F. to 2900° F. and a pressure in the range of about 2 to 250 atmospheres so that an equilibrium oxygen concentration with a partial pressure which is less than about $10^{-12}$ atmospheres is provided in the gas phase in said first reaction zone and in a downstream second reaction zone; and in said first reaction zone the O/C atomic ratio is in the range of about 0.3 to 1.1, the weight ratio of water to solid carbonaceous fuel plus liquid hydrocarbonaceous material, if any, is in the range of about 0.03 to 0.70, and about 70 to 98 wt. % of the carbon in said sulfur-containing fuel is converted into carbon oxides, thereby producing a hot gas stream including a raw product gas mixture comprising $H_2$, CO, $CO_2$, $H_2S$, COS, at least one gas selected from the group consisting of $H_2O$, $N_2$, $CH_4$, and A, and entrained material comprising particulate carbon, unreacted fuel if any, and molten slag; and the temperature is above the softening temperature of the ash in the fuel, and at least 90 wt. % of the sulfur in the fuel in the first reaction zone is converted into sulfur-containing gas;

(2) passing at least a portion of the hot gas stream from (1) in admixture with a second portion of said sulfur-containing fuel and a calcium-containing additive through a second unobstructed free-flow refractory lined reaction zone, wherein sufficient calcium-containing additive is introduced into the second reaction zone so as to provide calcium atoms in the amount of about 0.95 to 1.8 times the atoms of sulfur in the second reaction zone plus about 0.1 to 0.2 times the atoms of silicon in the ash in the second reaction zone, and the mole ratio of $H_2O$ and/or $CO_2$ to carbon in the second reaction zone is in the range of about 0.7 to 25;

(3) devolatilizing said second portion of sulfur-containing fuel and reacting in said second reaction zone in the absence of additional free-oxygen containing gas at a temperature below that in said first reaction zone and below the ash softening temperature, (i) $H_2O$ and/or $CO_2$ with carbon from said second portion of fuel, and carbon from the unreacted portion of said first portion of fuel, if any, to produce supplemental $H_2$ and carbon oxides, and (ii) said calcium-containing additive with the sulfur containing gases in the gas streams produced in steps (1) and (2) to produce particulate matter comprising calcium sulfide and combining in said second reaction zone a portion of said newly formed particulate matter and/or calcium-containing additive with slag and/or ash to produce fly-ash having an increased ash softening temperature; and (4) discharging from said second reaction zone a stream of synthesis gas, reducing gas, or fuel gas with entrained fly-ash and in comparison with a gas stream produced without the introduction of said calcium-containing additive in (2), the gas stream discharged from the second reaction zone contains a reduced amount of sulfur-containing gases, and increased amounts of $H_2$ + carbon oxides and calcium sulfide-containing particulate matter.

2. The process of claim 1 wherein said calcium-containing additive is introduced into the hot gas stream from (1) at the entrance to and/or at one or more locations within the second reaction zone.

3. The process of claim 1 provided with the step of contacting the hot gas stream passing through the central passage of said second reaction zone with an atomized spray of said calcium-containing additive.

4. The process of claim 1 provided with the step of separating at least a portion of the fly-ash from the gas stream in (4).

5. The process of claim 1 wherein the calcium-containing additive in (2) comprises an inorganic or an organic calcium compound.

6. The process of claim 1 wherein the said calcium-containing additive in (2) is an organic calcium compound selected from the group consisting of formate, oxalate, acetate, stearate, benzoate, tartrate, and mixtures thereof.

7. The process of claim 1 wherein the said calcium-containing additive is selected from the group consisting of calcium oxide, calcium hydroxide, calcium carbonate, calcium hydride, calcium nitrate, calcium phosphate, and mixtures thereof.

8. The process of claim 1 wherein the dwell times in the first and second reaction zones in (1) and (2) are respectively in the ranges of about 0.5–10 seconds and about 5 to 50 seconds.

9. The process of claim 1 wherein the hot stream of gas leaving the first reaction zone in (1) is introduced into the second reaction zone in (2) with substantially no change in temperature and pressure, except for ordinary losses of temperature and pressure in the lines.

10. The process of claim 1 wherein at least a portion of the entrained material and slag in the hot gas stream leaving the gas generator in (1) are removed respectively by gas-solids separation means and gravity prior to introducing the hot gas stream into the second reaction zone in (2).

11. The process of claim 1 wherein said sulfur-containing solid carbonaceous fuel is selected from the group consisting of coal, coke from coal; lignite; residue derived from coal liquefaction; oil shale; tar sands; petroleum coke; asphalt; pitch; particulate carbon (soot); and mixtures thereof.

12. The process of claim 1 wherein the calcium-containing additive in (2) is introduced into said second reaction zone at one or more levels between the top and bottom of said reaction zone.

13. The process of claim 1 wherein said sulfur-containing solid carbonaceous fuel is introduced into said second reaction zone in (2) entrained in a liquid or gaseous carrier.

14. The process of claim 13 wherein said liquid carrier is selected from the group consisting of water, liquid hydrocarbonaceous fuel, and mixtures thereof.

15. The process of claim 13 wherein said gaseous carrier is selected from the group consisting of steam, air, $N_2$, $CO_2$, recycle synthesis gas, and mixtures thereof.

16. The process of claim 1 in which said temperature moderator is selected from the group consisting of steam, water, $CO_2$-rich gas, liquid $CO_2$, $N_2$, recycle synthesis gas, exhaust gas from a turbine, and mixtures thereof.

17. The process of claim 1 in which said free-oxygen containing gas is selected from the group consisting of air, oxygen-enriched air, i.e. greater than 21 mole % $O_2$, and substantially pure oxygen, i. e. greater than about 95 mole % $O_2$.

18. The process of claim 1 wherein said mixture of solid carbonaceous fuel and calcium-containing additive is introduced downwardly into said second reaction zone entrained in a gaseous or liquid mixture.

19. The process of claim 1 wherein said solid carbonaceous fuel and supplemental calcium-containing material is introduced into the second reaction zone as a slurry in a liquid hydrocarbonaceous fuel.

20. The process of claim 1 where in (2) said second portion of sulfur-containing fuel comprises a pumpable slurry of solid carbonaceous fuel and calcium-containing material having a solids content of about 50–70 wt. % in a liquid carrier selected from the group consisting of $H_2O$ and $CO_2$; and provided with the step of skimming said liquid carrier prior to said mixture entering the second reaction zone to reduce the amount of $H_2O$ entering the second reaction zone to about 5 to 10 wt. % (basis weight of feed), or alternatively to reduce the amount of $CO_2$ entering the second reaction zone to about 10 to 30 wt. % (basis weight of feed).

21. The process of claim 1 provided with the steps of cooling and cleaning, the hot raw product gas mixture in (2) by contacting said raw product gas mixture with a liquid hydrocarbonaceous fuel cooling and scrubbing agent thereby producing a slurry comprising fly-ash and calcium sulfide in liquid hydrocarbonaceous fuel.

22. The process of claim 21 provided with the steps of steam stripping said slurry comprising fly-ash and calcium sulfide in liquid hydrocarbonaceous fuel and separating $H_2S$, and recycling the sulfur-depleted calcium-containing slurry to the second reaction zone.

23. The process of claim 22 provided with the step of recovering sulfur from the mixture of steam and $H_2S$.

24. The process of claim 1 provided with the step of cooling the hot gas stream from (4) by indirect heat exchange thereby producing by-product steam.

25. The process of claim 1 provided with the steps of separating particulate matter comprising calcium sulfide and particulate carbon from the partially cooled gas stream in a gas-solids separation zone, roasting said particulate matter thereby substantially producing calcium oxide and sulfurcontaining gas, and separating said calcium oxide from said sulfur-containing gas.

26. The process of claim 25 provided with the step of introducing a portion of said calcium oxide in admixture with make-up calcium-containing additive entrained in a carrier into the second reaction zone in (2), where said materials are mixed with said hot gas stream from (1).

27. The process of claim 25 provided with the step of introducing a portion of said calcium oxide into said partial oxidation reaction zone in (1) in admixture with said heavy liquid hydrocarbonaceous and/or solid carbonaceous fuel.

28. The process of claim 25 provided with the step of classifying said particulate matter prior to said roasting step and separating out materials having a particle size greater than about 100 microns.

29. The process of claim 28 provided with the step of mixing said materials having a particle size greater than about 100 microns with a second portion of said sulfur-containing heavy liquid hydrocarbonaceous fuel feed and/or sulfur containing solid carbonaceous fuel feed and introducing at least a portion of said mixture into the second reaction zone.

30. The process of claim 1 wherein the hot process gas stream from (1) is passed either in a downward or upward direction through said first and second reaction zones.

31. The process of claim 1 wherein said first and second reaction zones are coaxial and horizontally oriented.

32. The process of claim 1 wherein the hot gas stream from (1) is contacted in said second reaction zone with at least one atomized spray of calcium-containing additive at and/or beyond the entrance of said second reaction zone.

33. The process of claim 1 wherein an alkali metal and/or an alkaline earth metal compound is introduced into the second reaction zone in (2) in admixture with said calcium-containing additive and said second portion of fuel.

34. The process of claim 33 wherein said alkali metal and/or alkaline earth metal constituents are selected from the metals in the Periodic Table of Elements in Groups IA and/or IIA.

35. A continuous process for the production of desulfurized synthesis gas, fuel gas, or reducing gas comprising:

(1) mixing a first portion of sulfur-containing heavy liquid hydrocarbonaceous fuel and/or sulfur-containig solid carbonaceous fuel whose ashes include a minimum of 5.0 wt. % vanadium, a minimum of 2.0 wt. % of nickel, and silicon with additive A comprising an iron-containing additive when the silicon content of said fuel feedstock is less than about 350 ppm, additive B comprising an iron and calcium-containing additive when the silicon content of said fuel feedstock is about 400 ppm or more; and reacting said mixture by partial oxidation with a free-oxygen containing gas and in the presence of a temperature moderator in a first free-flow refractory lined reaction zone of a gas generator at an autogeneous temperature in the range of about 1900° F. to 2900° F. and above the softening temperature of the ash in the first reaction zone, and a pressure in the range of about 2 to 250 atmospheres to produce a hot stream of synthesis gas, reducing gas, or fuel gas comprising $H_2$, CO, $CO_2$, $H_2S$, COS and at least one gaseous material selected from the group consisting of $H_2O$, $N_2$, $CH_4$, $NH_3$, A, and containing entrained material comprising particulate carbon, unreacted fuel if any, and slag, wherein sufficient additive A or B is introduced into the first reaction zone so as to provide iron atoms when additive A is used or iron and calcium atoms when additive B is used in the amount of about 1.0 to 1.8 times the atoms of sulfur in the first reaction zone plus about 0.3 to 1.2 times the atoms of silicon in the ash in the second reaction zone; and for each part by weight of vanadium there is at least 10 parts by weight of iron when additive A is used, or at least 10 parts by weight of iron and calcium when additive B is used;

(2) passing at least a portion of the hot gas stream from (1) in admixture with a second portion of said sulfur-containing heavy liquid hydrocarbonaceous fuel and/or sulfur-containing solid carbonaceous fuel and a calcium-containing additive through a second unobstructed free-flow refractory lined reaction zone; wherein sufficient calcium-containing additive is introduced into the second reaction zone so as to provide calcium atoms in the amount of about 0.95 to 1.8 times the atoms of sulfur in the second reaction zone plus about 0.1 to 0.2 times the atoms of silicon in the ash from said second portion of sulfur-containing fuel, and the mole ratio of $H_2O$ and/or $CO_2$ to carbon in the second reaction zone is in the range of about 0.7 to 25.0; and the weight ratio of calcium-containing additive to ash in the second reaction zone is in the range of about 1.0–10.0 to 1.0;

(3) devolatilizing said second portion of sulfur-containing fuel and reacting in said second reaction zone in the absence of additional free-oxygen containing gas; and at a temperature below that in said first reaction zone and below the ash softening temperature, (i) $H_2O$ and/or $CO_2$ with carbon from said second portion of fuel, to produce supplemental $H_2$ and carbon oxides, and (ii) said calcium-containing additive with the sulfur containing gases in the gas streams produced in steps (1) and (2) to produce particulate matter comprising calcium sulfide and combining in said second reaction zone a portion of said newly formed particulate matter and/or calcium-containing additive with slag and/or ash to produce fly-ash having a reduced ash softening temperature; and (4) discharging from said second reaction zone a stream of synthesis gas, reducing gas, or fuel gas with entrained fly-ash; and in comparison with a gas stream produced without the introduction of said calcium-containing additive in (2), the gas stream discharged from the second reaction zone contains a reduced amount of sulfur-containing gases, and increased amounts of $H_2$ + carbon oxides and calcium sulfide-containing particulate matter.

36. The process of claim 35 wherein said iron-containing additive A contains iron compounds selected from the group consisting of oxides, carbonates, carbonyl, nitrates, and mixtures thereof.

37. The process of claim 35 wherein said additive B contains iron and calcium compounds selected from the group consisting of oxides, carbonates, nitrates, and mixtures thereof.

38. The process of claim 35 wherein said calcium-containing additive is selected from the group consisting of calcium oxide, calcium hydroxide, calcium carbonate, calcium hydride, calcium nitrate, calcium phosphate, and mixtures thereof.

39. The process of claim 35 provided with the step of removing at least a portion of the molten slag entrained in the effluent gas stream from the first reaction zone prior to the second reaction zone

* * * * *